US006951079B2

(12) United States Patent
Weiss

(10) Patent No.: US 6,951,079 B2
(45) **Date of Patent: *Oct. 4, 2005**

(54) SYSTEM AND METHOD OF PANELIZED CONSTRUCTION

(75) Inventor: Arvin Weiss, Denver, CO (US)

(73) Assignee: Fairfax Express Corporation, Denver, CO (US)

( * ) Notice: Subject to any disclaimer, the term of this patent is extended or adjusted under 35 U.S.C. 154(b) by 325 days.

This patent is subject to a terminal disclaimer.

(21) Appl. No.: 10/118,357

(22) Filed: Apr. 9, 2002

(65) Prior Publication Data

US 2002/0129577 A1 Sep. 19, 2002

Related U.S. Application Data

(62) Division of application No. 09/492,145, filed on Jan. 27, 2000, now Pat. No. 6,438,903.

(51) Int. Cl.[7] ..... E04H 1/00

(52) U.S. Cl. ..... 52/79.1; 52/58; 52/60; 52/79.9; 52/83; 52/90; 52/92; 52/122.1; 52/126.5; 52/220; 52/220.2; 52/221; 52/236.3; 52/284; 52/289

(58) Field of Search ..... 52/220, 289, 284, 52/79.1, 90, 741, 58, 66, 122.1, 126.5, 236.3, 83, 92, 220.2, 221, 79.9

(56) References Cited

U.S. PATENT DOCUMENTS

| | | | | |
|---|---|---|---|---|
| 2,287,229 A | | 6/1942 | Carpenter | |
| 2,706,313 A | | 4/1955 | Radman | |
| 2,883,711 A | | 4/1959 | Kump | |
| 3,562,972 A | | 2/1971 | D'Amato | |
| 3,697,633 A | | 10/1972 | Edgar | |
| 3,707,165 A | | 12/1972 | Stahl | |
| 3,717,965 A | | 2/1973 | Morton et al. | |
| 4,100,708 A | * | 7/1978 | Bobrovnikov et al. | 52/222 |
| 4,207,714 A | | 6/1980 | Mehls | |
| 4,282,693 A | * | 8/1981 | Merklinger | 52/282.5 |
| 4,418,463 A | * | 12/1983 | McNeill | 29/527.4 |
| 4,467,585 A | | 8/1984 | Busby | |
| RE31,733 E | | 11/1984 | Haworth et al. | |

(Continued)

OTHER PUBLICATIONS

PCT–International Search Report dated May 1, 2001 for application Ser. No. PCT/US00/42341, filed Nov. 29, 2000.

PCT–International Search Report dated Jun. 28, 2001 for application Ser. No. PCT/US00/42339, filed Nov. 29, 2000.

PCT–International Search Report dated Aug. 27, 2001, for application Ser. No. PCT/US00/42340, filed Nov. 29, 2000.

Scott, R. W. "Killer VARs ring up strong sales", Accounting Technology, vol. 15, No. 10, Nov. 1999, pp. 1–18.

*Primary Examiner*—Carl D. Friedman
*Assistant Examiner*—Christy Green
(74) *Attorney, Agent, or Firm*—Hunton & Williams LLP

(57) ABSTRACT

A system and method of panelized construction for use in construction of a building module, such as a residential housing addition. A plurality of pre-fabricated panels, such as wall panels, roof panels, floor panels, and ceiling panels may be provided to decrease on-site building time. The panels may comprise one or more covering layers pre-installed on a frame. The panels may also comprise pre-installed insulation or other core materials. The panels may further comprise a pre-installed portion of a house system, such as an electrical system. Additionally, the panels may comprise pre-installed windows, doors, or skylights. The panels may be designed to meet the residential building code requirements of one or more jurisdictions to decrease permitting time and inspection delays. The panels and other materials may be included in a building kit for a building module to be constructed by contractors or do-it-yourselfers.

14 Claims, 6 Drawing Sheets

U.S. PATENT DOCUMENTS 4,622,787 A 11/1986 Scott
4,653,239 A 3/1987 Randa
4,745,719 A 5/1988 Blankstein et al.
4,852,316 A 8/1989 Webb
4,942,707 A * 7/1990 Huettemann ..... 52/259
4,955,174 A 9/1990 Valente et al.
4,972,318 A 11/1990 Brown et al.
5,065,338 A 11/1991 Phillips et al.
5,076,310 A 12/1991 Barenburg
5,103,604 A 4/1992 Teron
5,365,705 A * 11/1994 Crowley et al. ..... 52/90.1
5,570,292 A 10/1996 Abraham et al.
5,715,636 A * 2/1998 Taylor ..... 52/308
5,729,936 A 3/1998 Maxwell
5,740,858 A 4/1998 Ingram
5,806,046 A 9/1998 Curran et al.
5,893,082 A 4/1999 McCormick
5,918,219 A 6/1999 Isherwood
5,921,047 A * 7/1999 Walker ..... 52/585.1
5,953,871 A 9/1999 MacConnell et al.
6,003,279 A * 12/1999 Schneider ..... 52/481.1
6,041,310 A 3/2000 Green et al.
6,063,996 A * 5/2000 Takada et al. ..... 136/246
6,088,970 A * 7/2000 Doran ..... 52/92.1
6,588,161 B2 * 7/2003 Smith ..... 52/233

* cited by examiner

SYSTEM AND METHOD OF PANELIZED CONSTRUCTION

This application is a divisional of U.S. patent Ser. No. 09/492,145, filed Jan. 27, 2000, now U.S. Pat. No. 6,438,903.

FIELD OF THE INVENTION

This invention relates to the field of panelized construction for residential building modules.

BACKGROUND OF THE INVENTION

Many of the homes dominating the American landscape no longer provide adequate space to meet the needs and desires of the American family. One to three bedroom homes, homes lacking a family room or den, and homes with only single car garages are insufficient for many families' needs. Further, home offices have become increasingly popular and have placed additional demands on the space available in many existing homes. While moving to a larger home may be an option for some families, others cannot afford the expense and inconvenience of moving. Existing relationships with community schools and activities, local houses of worship and other conveniences, and nearby friends and family may also be a deterrent to moving. Further, as cities and suburbs expand, and the available spaces for new development decrease, something will need to be done about the functionally obsolete, though otherwise desirable, existing homes.

Unfortunately, the prospect of adding a housing addition can be daunting. Hiring an architect to design a compatible addition can be expensive and time consuming. A new design may take 2–3 months to prepare and customization of the design to the homeowner's needs may require considerable time and effort from the homeowner. After preparation, review of the plans for the appropriate building permits may take 6–10 weeks.

Finding an available contractor and getting financing for both the design and building stages may require additional time and effort. Engaging a contractor to build the addition adds additional expenses and even the hardiest do-it-yourselfer generally lacks the tools and expertise to construct an entire addition from the ground up. Homeowners may have difficulty finding a contractor they can trust and may fear being overcharged or provided with sub-standard workmanship and materials. Reliable and inexpensive architects and contractors may be difficult to find.

Homeowners may also be discouraged by the time and mess associated with the construction of a housing addition. Construction of an addition, even after permits are in place, typically takes 2–3 months and may be made longer by weather delays, inspection delays, building mistakes, lack of contractor and sub-contractor availability, and other delays. Protracted construction on an existing property can wreak havoc with family routines, strain relationships with neighbors, and render the general aesthetics and utility of the existing property undesirable for the duration of the construction. There is a need for a fast and inexpensive way to design and construct a house addition.

Kit construction. the use of a pre-fabricated kit to construct a building, has been around for many years. Perhaps the most common forms of kit construction are log home kits and the kits used by some contractors to construct a large number of similar tract homes. In many kits, wall frames and trusses are pre-fabricated at a factory and delivered to the building site. The wall frames may include window and door frames, and exterior wall frames may have plywood or similar coverings pre-installed on their exteriors. At the building site, the frames and trusses are positioned using a building crane and attached using pneumatic nail guns or similar devices. Further framing may be required on-site. Plywood exteriors may be added to the walls and roof and the roof may be covered, for example, by shingles or other roofing materials. The various house systems, such as plumbing, electrical, and HVAC may be installed. Windows and doors may be installed. Drywall may be added on the interior of walls and ceilings and various stages of finishing work, such as painting and installing siding, flooring, cabinetry, fixtures, molding, and other items, may be completed.

Such building kits may require special equipment, such as building cranes, to assemble. They may require special expertise for installing house systems and finishing. They may be challenging to customize or redesign due to the use of large, building specific, pre-fabricated sections. They may require considerable on-site labor to assemble and complete and on-site completion may provide considerable opportunity for human error, failed inspections, and other delays. Such building kits may be incompatible with existing buildings, lot sizes, and lot shapes.

These and other drawbacks of prior art systems are overcome by the various embodiments of the invention.

SUMMARY OF THE INVENTION

It is an object of the invention to overcome the above-described drawbacks and others by providing a system and method of panelized construction for residential housing additions.

These and other objects of the invention are achieved by a building module comprising a plurality of pre-fabricated wall panels and a plurality of pre-fabricated roof panels. Each pre-fabricated wall panel comprises a frame having a first side, a second side, and a plurality of edges. Each pre-fabricated wall panel also comprises a first wall covering layer disposed on the first side. Each pre-fabricated roof panel comprises a frame having an exterior side, an interior side, and a plurality of edges. Each pre-fabricated roof panel also comprises a first roof covering layer disposed on the exterior side. A structural design is provided by which the pre-fabricated wall panels and roof panels are constructed and positioned and attached in relation to one another. The structural design meets at least the minimum structural standards of residential building codes in at least one jurisdiction.

These and other objects of the preferred embodiments are also achieved by a pre-fabricated panel for use in panelized construction. Such a pre-fabricated panel comprises a frame having a first side, a second side, and a plurality of edges. Such a pre-fabricated panel also includes a first covering layer disposed on the first side and a second covering layer disposed on the second side.

These and other objects of the preferred embodiments are also achieved by a building kit for constructing a building module. The building kit comprises a plurality of pre-fabricated wall panels and a plurality of pre-fabricated roof panels. Each of the wall panels comprises a frame having a first side, a second side, and a plurality of edges. Each of the wall panels also comprises a first wall covering layer disposed on the first side. Each of the wall panels also comprises a second wall covering layer disposed on the second side. Each of the roof panels comprises a frame having an exterior side, an interior side, and a plurality of edges. Each of the roof panels also comprises a first roof covering layer disposed on the exterior side.

These and other objects of the preferred embodiments are also achieved by a method of constructing a building module. The method comprises the steps of providing a base structure for the building module; positioning a plurality of pre-fabricated wall panels on the base structure; attaching the plurality of wall panels to the base structure and to each other to form a wall system; positioning a plurality of pre-fabricated roof panels on the wall system; attaching the plurality of pre-fabricated roof panels to the wall system and to each other. Each wall of the panels comprises a frame having a first side, a second side, and a plurality of edges. Each of the wall panels also includes a first wall covering layer disposed on the first side. Each of the wall panels also comprises a second wall covering layer disposed on the second side. Each of the roof panels comprises a frame having an exterior side, an interior side, and a plurality of edges. Each of the roof panels also comprises a first roof covering layer disposed on the exterior side.

The accompanying drawings, which are incorporated in and constitute a part of this specification, illustrate an embodiment of the invention and, together with the description, serve to explain the principles of the invention.

DETAILED DESCRIPTION OF THE PREFERRED EMBODIMENTS

Figure 1:
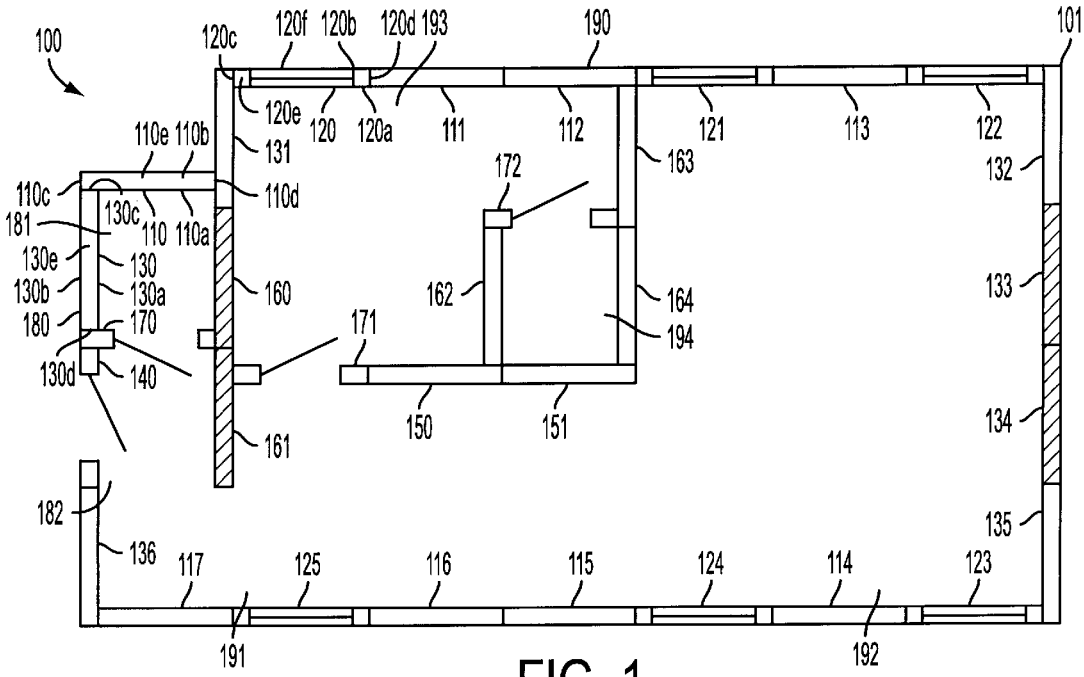
FIG. 1 is an overhead view of the panelized wall system of a one story housing addition according to an embodiment of the invention.

In one embodiment of the invention, panelized construction may provide a way to greatly expedite on-site construction for a building module. Panelized construction may be particularly beneficial for increasing the speed and efficiency with which a housing addition can be built. Panelized construction may allow a considerable amount of the construction to be done in a factory off-site. Off-site construction may benefit from mass production, resident expertise, and superior quality control. Panelized construction allows a building module design to be broken down into manageable portions, such as 4' wide wall, roof, and floor sections. Because the panels may be substantially flat and of fairly standardized size, it is practical to move large numbers of them over great distances using conventional hauling methods.

Panelized construction may also facilitate interchangeability and customization of building module designs. By using standardized wall, ceiling, and floor panels, building module designs may be easily redesigned and customized. Interior and exterior walls may be shifted and interchanged to provide a near infinite variety of designs based on a relatively small selection of panels. Variety of design and customization may be particularly beneficial to housing additions. Different homeowners may have radically varying needs. Some may need additional bedroom space, while others may need additional garage space, a home office, or a family room, playroom, or utility room.

The efficiency of construction of the housing addition may be further enhanced by providing as much of the construction as is feasible pre-installed in the panel. A panel may include a frame which provides the structure of the building module. Pre-installation of doors, windows, and skylights within the panel frames may substantially decrease on-site building time. Pre-installing insulation and both interior and exterior wall covering layers on the frame may also substantially decrease on site-building time. For example, a panel may have pre-installed insulation, as well as drywall on the interior surfaces and sheeting and siding on the exterior surfaces. Another way to improve on-site building times is to provide one or more house systems at least partially built into the pre-fabricated panels. For example, the pre-fabricated panels may be provided with electrical wiring and outlet boxes and electrical fixture housings already pre-installed. Panels may also be pre-installed with other wire networks, such as cable, telephone, audio wiring, security systems, and others. Panels may also be pre-installed with portions of a plumbing, heating, ventilation, or air conditioning system.

Another way to increase the speed with which a panelized building module may be completed is to provide prefabricated panels and building module designs which meet or exceed the residential building codes of jurisdictions in which the building modules may be constructed. While this may not directly increase the actual speed with which the building module is assembled, it may radically decrease the time required to secure permits and inspections. Further, it may prevent costly delays, rebuilds and modifications due to failed inspections. Standardized building codes are frequently adopted with little or no modification in a plurality of jurisdictions. Standardized building codes may facilitate the ability to produce panels and building module designs complying with the building codes in a plurality of jurisdictions. Standardized building codes may include: the 1994 Standard Building Code, the 1996 BOCA National Building Code, the 1997 Uniform Building Code, the Canadian Building Code, the pending 2000 International Building Code, and other codes.

FIG. 1 shows a one story housing addition 100 embodying the invention. FIG. 1 shows an overhead view of a wall system 101 comprising the interior and exterior walls of housing addition 100. Wall system 101 is comprised of a plurality of wall panels, including a plurality of parallel exterior wall panels 110, 111, 112, 113, 114, 115, 116, and 117; a plurality of parallel exterior wall panels with windows 120, 121, 122, 123, 124, and 125; a plurality of perpendicular exterior wall panels 130, 131, 132, 133, 134, 135, and 136; an exterior door panel 140; a plurality of interior parallel wall panels 150 and 151; a plurality of interior perpendicular wall panels 160, 161, 162, 163, and 164; and a plurality of interior parallel wall panels with doors 170, 171, and 172. Wall system 101 defines a transition module 180. The internal space of transition module 180 may define a closet 181 and an entry way 182. Wall system 101 further defines a main module 190. The internal space of main module 190 may define a hallway 191, a family room 192, an office 193, and a closet 194.

In one embodiment, each wall panel may comprise a frame. Each wall panel may have a first side and a second side and a plurality of edges. For example, wall panel 110 may have a first interior side 110*a*, a second exterior side 110*b*, a first lateral edge 110*c*, a second lateral edge 110*d*, a top edge 110*e*, and a bottom edge (not shown). Each wall panel is connected to an adjacent wall panel, frequently along one or both lateral edges. Each wall panel is also anchored to a floor or an appropriate base structure. Each wall panel may also be connected to one or more of a plurality of roof panels. Each wall panel may have one or more covering layers disposed on and substantially covering one or both of the sides. For example, wall panel 110 may have gypsum wall board on its interior side 110*a* and siding on its exterior side 110*b* or wall panel 150 may have gypsum wall board on both sides. Each wall panel may also comprise core material, such as insulation, or a portion of a house system, such as wiring for an electrical system. Each wall panel may also have a door or window built into the panel.

In one embodiment, each panel may also have a portion of an attachment assembly for attaching the panel to neighboring panels, the floor, and roof and/or ceiling panels. In one embodiment, attachment to neighboring panels may be accomplished by nails driven at angles through the frames of the neighboring panels. In one embodiment, attachment to neighboring panels may be accomplished by nut and bolt assemblies inserted through holes in adjacent panel frames. Where the panels have pre-installed coverings on both sides, access openings may be left to permit access to the frame for use of nut and bolt assemblies or similar assemblies. Other attachment assemblies might include: hinges, fastening plates, screws, adhesives, rods, rivets, welds, wires, cables, toggle bolts, dowels, snap-in-place assemblies, ratchet bolts, keys, tongue and groove assemblies, and combinations of one or more thereof. Panels may be attached to the floor of the building module or another base structure, such as the walls of a basement foundation. In one embodiment, panels are attached to a sill which is attached to the floor or other base structure. In one embodiment, attachment to the sill may be accomplished by nails angled through the wall panel frame and into the sill. In another embodiment, the sill and the bottom edge of the wall panel may each have a one of complimentary tongue and groove for mating interconnection of the still and bottom edge of the wall panel to facilitate increased stability.

In a third embodiment, parallel exterior wall panels 110, 111, 112, 113, 114, 115, 116, and 117 are positioned parallel to a central axis of the building module and comprise at least a portion of the exterior walls of wall system 101. Wall panel 110 may be attached to exterior wall panels 130 and 131. Wall panel 111 may be attached to wall panels 120 and 112. Wall panel 112 may be attached to wall panels 111 and 121. Wall panel 113 maybe attached to wall panels 121 and 122. Wall panel 114 may be attached to wall panels 123 and 124. Wall panel 115 may be attached to wall panels 124 and 116. Wall panel 116 may be attached to wall panels 115 and 125. Wall panel 117 may be attached to wall panels 125 and 136. In this embodiment, parallel exterior wall panels 110, 111, 112, 113, 114, 115, 116, and 117 may be standardized to 4 feet wide and built within 1/16" tolerance.

In another fourth embodiment, parallel exterior wall panels with windows 120, 121, 122, 123, 124, and 125 are positioned parallel to a central axis of the building module and comprise at least a portion of the exterior walls of wall system 101. Wall panel 120 may be attached to wall panels 131 and 111. Wall panel 121 may be attached to wall panels 112 and 113. Wall panel 122 may be attached to wall panels 113 and 132. Wall panel 123 may be attached to wall panels 135 and 114. Wall panel 124 may be attached to wall panels 114 and 115. Wall panel 125 may be attached to wall panels 116 and 117. Each wall panel may comprise a wooden frame defining an opening for a window. Each wall panel may have a window, such as window 120*f*, disposed within the opening in the frame. In one embodiment, parallel exterior wall panels with windows 120, 121, 122, 123, 124, and 125 may be standardized to 4 feet wide and built within 1/16" tolerance.

In another fifth embodiment, perpendicular exterior wall panels 130, 131, 132, 133, 134, 135, and 136 are positioned perpendicular to a central axis of the building module and comprise at least a portion of the exterior walls of wall system 101. Wall panel 130 may attach to wall panels 170 and 110. Wall panel 131 may attach to wall panels 160, 110, and 120. Wall panel 132 may attach to wall panels 122 and 133. Wall panel 133 may attach to wall panels 132 and 134. Wall panel 134 may attach to wall panels 133 and 135. Wall panel 135 may attach to wall panels 134 and 123. Wall panel 136 may attach to wall panels 117 and 140. The frame of each of the wall panels 130, 131, 132, 133, 134, 135, and 136 may comprise a portion of a truss for supporting one or more of a plurality of roof panels. In one embodiment, perpendicular exterior wall panels 130, 131, 132, 133, 134, 135, and 136 may be standardized to 4 feet wide and built within 1/16" tolerance. In another embodiment, one or more wall panels, such as wall panels 133 and 134, may be reinforced with a more structurally resilient frame and attachment mechanisms to act as a shear wall for resisting lateral stresses to the building module.

In another sixth embodiment, exterior door panel 140 is positioned perpendicular to a central axis of building module 100 and may comprise at least a portion of the exterior walls of wall system 101. Door panel 140 may attach to wall panels 136 and 170. The frame of door panel 140 may comprise a portion of a truss for supporting one or more of a plurality of roof panels. Door panel 140 may comprise a wooden frame defining an opening for a door. Door panel 140 may have a door 140*f* disposed within the opening in the frame. Panel 140 may be designed to mate with an opening in and existing building module, such as a house. In this embodiment, exterior perpendicular wall panel with door 140 may be standardized to 4 feet wide and built within 1/16" tolerance.

In another seventh embodiment, interior parallel wall panels 150 and 151 are positioned parallel to a central axis of building module 100 and comprise at least a portion of the internal walls of wall system 101. Wall panel 150 may be attached to wall panels 171 and 151. Wall panel 151 may be attached to wall panels 171 and 164. In this embodiment, interior parallel wall panel 140 may be standardized to 4 feet wide and built within 1/16" tolerance.

In one embodiment, interior perpendicular wall panels 160, 161, 162, 163, and 164 are positioned perpendicular to a central axis of building module 100 and comprise at least a portion of the internal walls of wall system 101. Wall panel 160 may be attached to wall panels 161, 131, and 140. Wall panel 161 maybe attached to wall panels 160 and 171. Wall panel 162 may be attached to panels 150 and 172. Wall panel 163 may be attached to wall panels 112, 172, and 164. Wall Panel 164 may be attached to wall panels 163 and 151. The frame of each of the wall panels 160, 161, 162, 163, and 164 may comprise a portion of a truss for supporting one or more of a plurality of roof panels. In this embodiment, the interior perpendicular wall panels 160, 161, 162, 163, and 164 may be standardized to 4 feet wide and built within 1/16" tolerance. Moreover, one or more of the wall panels, such as wall panels 160 and 161, may be reinforced with a more structurally resilient frame and attachment mechanisms to act as a shear wall for resisting lateral stresses to the building module.

In another seventh embodiment, interior parallel wall panels with doors 170, 171, and 172 are positioned parallel to a central axis of building module 100 and comprise at least a portion of the internal walls of wall system 101. Wall panel 170 may be attached to wall panels 140, 130, and 160. Wall panel 171 may be attached to wall panels 161 and 150. Wall Panel 172 may be attached to wall panels 162 and 163. Wall panels 170, 171, and 172 may each comprise a wooden frame defining an opening for a door. Wall panels 170, 171, and 172 may have a door 140*f* disposed within the opening in the frame. In this embodiment, interior parallel wall panels with doors 170, 171, and 172 may be standardized to 4 feet wide and built within 1/16" tolerance.

Wall system 101 may be designed to meet or exceed the residential building codes of at least one jurisdiction. By exceeding residential building code standards, a panelized building module, such as module 100, to be certified and pre-approved by local construction authorities. For example, in one embodiment, wall system may provide multiple paths of egress meeting the requirements of residential building codes in a plurality of jurisdictions.

In another eighth embodiment, wall system 101 may be comprised entirely of wall panels standardized to a particular width, such as 4' panels. In one embodiment, a plurality of panels of widths larger or smaller than the standard panels may be used to supplement the standard panels. The use of a few non-standard panel widths may dramatically increase internal and external design and customization options. Non-standard panels may also allow standard sections to be offset from one another. An offset may stagger the seams between panels and improve building module stability.

Figure 2:
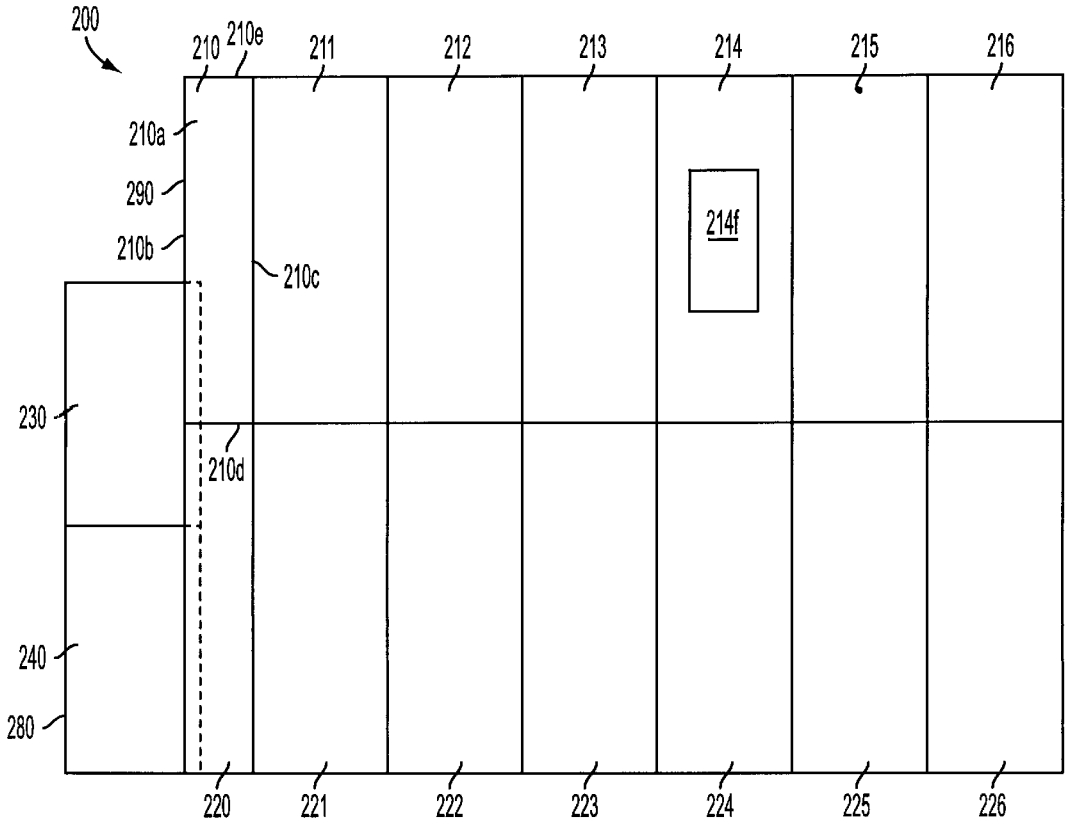
FIG. 2 is an overhead view of the panelized roof system of a one story housing addition, such as the housing addition of FIG. 1, according to an embodiment of the invention.

FIG. 2 shows a roof structure 200 for building module 100 according to an embodiment of the invention. Roof structure 200 comprises a plurality of roof panels 210, 211, 212, 213, 214, 215, 216, 220, 221, 222, 223, 224, 225, 226, 230, and 240. Roof Panels 230 and 240 provide a roof over transition module 280 and roof panels 210, 211, 212, 213, 214, 215, 216, 220, 221, 222, 223, 224, 225, and 226 provide a roof over main module 290.

In another ninth embodiment, each of the roof panels 210, 211, 212, 213, 214, 215, 216, 220, 221, 222, 223, 224, 225, 226, 230 and 240 may comprise a wooden frame. Each roof panel may have a first side and a second side and a plurality of edges. For example, roof panel 210 may have an interior or ceiling side (not shown), an exterior or roof side 210*a*, a first lateral edge 210*b*, a second lateral edge 210*c*, a top edge 210*d*, and a bottom edge 210*e*. Each roof panel may be connected to at least one adjacent roof panel along at least one lateral edge, for example roof panel 210 may be connected to roof panel 211. Each roof panel may be connected to at least one opposite roof panel along a top edge, for example roof panel 210 may be connected to roof panel 220. Each roof panel may also be anchored one or more wall panels. In this embodiment, each roof panel may be connected to a ridge beam (not shown), which traverses a central axis of building module 100. The ridge beam may be supported by the wall system, on independent supports, such as pipe columns, or a combination of the two. The top edge of each roof panel may be connected to the ridge beam. The bottom edge of each roof panel, or a portion proximate thereto, may be connected to the top edge of at least one parallel exterior wall panel, such as wall panel 111. One or more roof panels may also be supported by a truss portion built into the frame of one or more perpendicular wall panels, such as wall panel 160. Each roof panel may have one or more covering layers disposed on and substantially covering one or both sides. For example, roof panel 210 may have gypsum wall board on its interior side and plywood sheathing on its exterior side. Each roof panel may also comprise core material, such as insulation, or a portion of a house system, such as wiring for an electrical system. One or more of the roof panels may have a skylight built into the roof panel.

In another tenth embodiment, each roof panel may also have a portion of an attachment assembly for attaching the roof panel to neighboring roof panels, wall panels, and/or the ridge beam. In this embodiment, attachment to neighboring roof panels, wall panels, and/or the ridge beam may be accomplished by nails driven at angles through the frames of the neighboring roof panels, or by nut and bolt assemblies inserted through holes in adjacent frames or the beam. Where the roof panels have pre-installed coverings on both sides, access openings may be left in the roof panels to permit access to the frame for use of nut and bolt assemblies or similar assemblies. Other attachment assemblies might include: hinges, fastening plates, screws, adhesives, rods, rivets, welds, wires, cables, toggle bolts, dowels, snap-in-place assemblies, ratchet bolts, keys, tong and groove assemblies, and combinations of one or more thereof.

In another eleventh embodiment, roof panel 210 may be attached to roof panels 211 and 220 and wall panels 160, 131, and 120. Roof panel 211 may be attached to roof panels 210, 212, and 221 and wall panels 120 and 111. Roof panel 212 may be attached to roof panels 211, 213, and 222 and wall panels 111, 112, 172, and 162. Roof panel 213 maybe attached to roof panels 212, 214, and 223 and wall panels 112, 121, 163, 164, and 172. Roof panel 214 may be attached to roof panels 213, 215, and 224 and wall panels 121 and 113. Roof panel 215 may be attached to roof panels 214, 216, and 225 and wall panels 113 and 122. Roof panel 216 may be attached to roof panels 215 and 226 and wall panels 122, 132, and 133. Roof panel 220 may be attached to roof panels 221 and 210 and wall panels 117, 125, 161, and 171. Roof panel 221 may be attached to roof panels 220, 222, and 211 and wall panels 125, 116, 171, and 150. Roof panel 222 may be attached to roof panels 221, 223, and 212 and wall panels 116, 115, 150, 151, and 162. Roof panel 223 may be attached to roof panels 222, 224 and 213 and wall panels 115, 124, 151, and 194. Roof panel 224 may be attached to roof panels 223, 225, and 214 and wall panels 124 and 114. Roof panel 225 may be attached to roof panels 224, 226, and 215 and wall panels 114 and 123. Roof panel 226 may be attached to roof panels 225 and 216 and wall panels 123, 135, and 134.

In this above-described embodiment, roof panels 211, 212, 213, 214, 215, 216, 221, 222, 223, 224, 225, and 226 may be standardized to 4 feet wide and built within 1/16" tolerance. Roof panels 210 and 220 may be of a non-standard width to compensate for roof overhang beyond the wall system and to offset the seams in roof system 200 from the seams in the wall system 101. In this embodiment, roof panel 214 comprises an opening accommodating a skylight 214*f*. Skylight 214*f* may be pre-installed in roof panel 214.

In another fifth embodiment, roof panel 230 may be attached to roof panel 240 and wall panels 170, 130, 110, 131, and 160. Roof panel 240 may be attached to roof panel 230 and wall panels 140, 136, 117, and 161. In this embodiment, roof panels 230 and 240 may be attached to an exterior wall of a house (not shown), and may be standardized to 4 feet wide and built within 1/16" tolerance.

Roof system 200 may be designed to meet to exceed the residential building codes of at least one jurisdiction. Exceeding building code standards may allow a panelized building module, such as module 100, to be certified and pre-approved by local construction authorities. In this embodiment, roof system 200 may have insulation pre-installed such that air spaces for cross-ventilation are preserved within roof system 200. This may meet the cross-ventilation requirements of residential building codes in a plurality of jurisdictions.

Figures 3A, 3B, 3C, 3D:
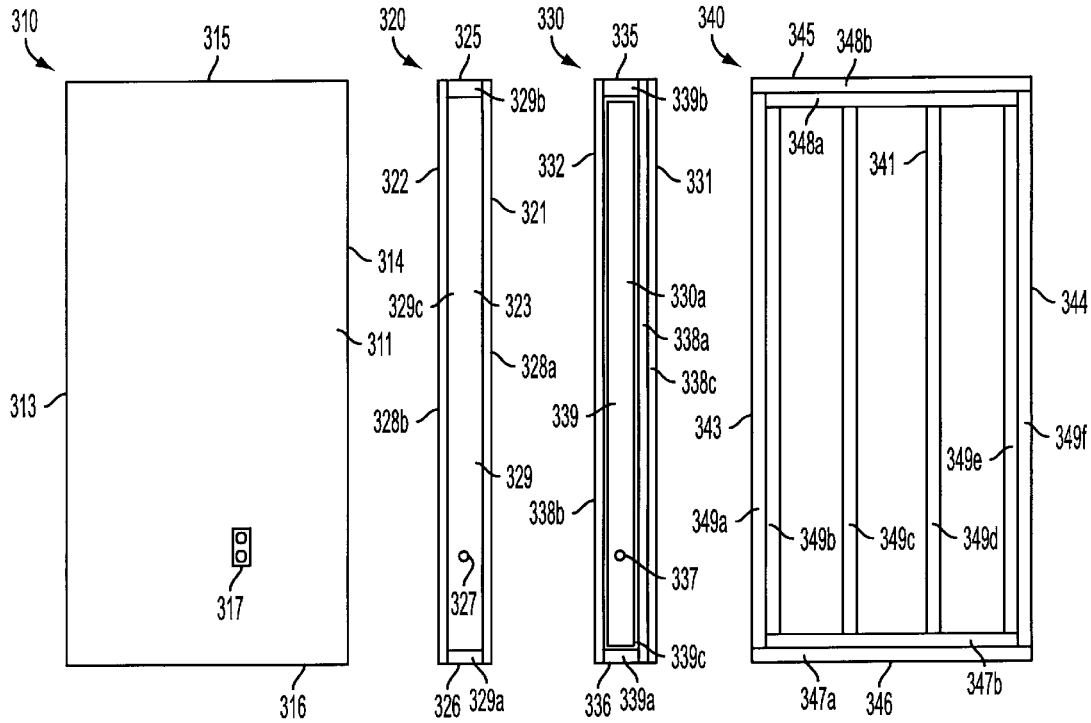
FIG. 3*a* is a front view of an interior side of a wall panel of an embodiment of the invention.
FIG. 3*b* is a side view of a wall panel, such as the wall panel of FIG. 3*a*, according to an embodiment of the invention.
FIG. 3*c* is a cross-sectional view of a wall panel, such as the wall panel of FIG. 3*a*, according to another embodiment of the invention.
FIG. 3*d* is a front view of the frame of a wall panel, such as the wall panel of FIG. 3*a*, according to an embodiment of the invention.

FIGS. 3*a*–3*g* show a plurality of wall panels for use in panelized construction of a building module, such as building module 100. FIG. 3*a* shows a front view of the side of a wall panel 310. Wall panel 310 has a first side 311, a second side (not shown), a first lateral edge 313, a second lateral edge 314, a top edge 315, and a bottom edge 316. Wall panel 310 may be used in a wall system, such as wall system 101. For example, wall panel 310 may be a portion of an internal or external parallel wall, like wall panels 110 or 150 in wall system 101. In this embodiment, first side 311 may have a wall covering layer disposed thereon. The second side of the wall panel 310 (not shown) may also have a wall covering layer disposed thereon. In this embodiment, the wall covering layers may not extend to one or more of edges 313, 314, 315, or 316. The gap in the wall covering layers may facilitate attachment of adjacent panels by providing access to the frame of wall panel 310. After adjacent wall panels are joined, the gap in the wall covering layer may be sealed using an appropriately sized member of the covering material or another method. Sealing the seams between adjacent wall panels with a member which spans any gap between the panels may prevent weather and other undesired objects from penetrating the wall system. Additionally, the gap spanning member may provide a better base for further finishing of the wall panel surfaces. In this embodiment, wall panel 310 may also have a portion of a house system pre-installed in it. For example, the pre-installed house system may be an electrical system and wall panel 310 may include a pre-installed electrical outlet 317.

FIG. 3*b* shows an edge view of a wall panel 320. Wall panel 320 may be an embodiment of wall panel 310, shown in FIG. 3*a*. Wall panel 320 has a first side 321, a second side 322, a first lateral edge 323, a second lateral edge (not shown), a top edge 325, and a bottom edge 326. Wall panel 320 may have a first wall covering layer 328*a* and a second wall covering layer 328*b* disposed on either side of a frame 329. Wall covering layers 328*a* and 328*b* may comprise any suitable material, such as gypsum wallboard, plywood sheathing, siding, paneling, or other materials. Pre-installing wall covering layers 328*a* and 328*b* on the wall panel 320 may save on-site building time. In some cases, the need to access the interior of a wall panel, such as to reach the inside of the frame for attaching adjacent wall panels or to install wall bound portions of house systems, may encourage providing one or more access openings in at least one of the wall covering layers. An appropriate covering for the access opening may also be provided. Frame 329 may comprise a base member 329*a* and a top member 329*b* and a plurality of vertical members, such as member 329*c*. Wall panel 320 may further comprise a pre-installed portion of a house system, such as conduit 327. In 110 this embodiment, the house system may be an electrical system and conduit 327 may comprise electrical wiring. Conduit 327 may comprise wiring for other systems as well, such as cable wiring, telephone wiring, speaker wiring, or security system wiring. Alternatively, conduit 327 may provide a portion of a heating, cooling, or ventilation system, or a plumbing system.

FIG. 3*c* shows a cross-sectional view of a wall panel 330. Wall panel 330 may be an embodiment of wall panel 310, shown in FIG. 3*a* Wall panel 330 has a first side 331, a second side 332, a first lateral edge (not shown), a second lateral edge (not shown), a top edge 335, and a bottom edge 336. Wall panel 330 may have a first wall covering layer 338*a*, a second wall covering layer 338*b*, and a wall finishing layer 338*c* disposed on either side of a frame 339. Wall covering layers 338*a* and 338*b* and wall finishing layer 338*c* may be comprised of any suitable material, such as gypsum wallboard, plywood sheathing, siding, paneling, or other materials. Pre-installing wall covering layers 338*a* and 338*b* and wall finishing layer 338*c* on wall panel 330 may save on-site building time. In this embodiment, the combination of a wall covering layer 338*a* and wall finishing layer 338*c* may provide a one hour fire rated assembly. In some cases, the need to access the interior of the wall panel 330, such as to reach the inside of the frame for attaching adjacent wall panels or to install wall bound portions of house systems, may encourage providing one or more access openings in at least one of the wall covering layers. An appropriate covering for the access opening may also be provided. Frame 339 may comprise a base member 339*a* and a top member 339*b* and a plurality of vertical members, such as member 339*c*. Wall panel 330 may further comprise a pre-installed core layer, such as core layer 330*a*. In this embodiment, core layer 330*a* may be comprised of R19 insulation. Pre-installation of core layers for the wall panel 330 may decrease on-site building time. Wall panel 330 may further comprise a pre-installed portion of a house system, such as conduit 337. In such embodiment, the house system may be an electrical system and conduit 337 may be comprised of electrical wiring. Conduit 337 may further comprise wiring for other systems as well, such as cable wiring, telephone wiring, speaker wiring, or security system wiring. Alternatively, conduit 337 may comprise a portion of a heating, cooling, or ventilation system, or plumbing system.

FIG. 3*d* shows a front view of a frame 340. Frame 340 may be an embodiment of frames 329 or 339, as shown in FIGS. 3*b* and 3*c*. Frame 340 has a first side 341, a second side (not shown), a first lateral edge 343, a second lateral edge 344, a top edge 345, and a bottom edge 346. Frame 340 may be comprised of a plurality of base members 347*a* and 347*b*, a plurality of top members 348*a* and 348*b*, and a plurality of vertical members 349*a*, 349*b*, 349*c*, 349*d*, 349*e*, 349*f*, and 349*f*. In one embodiment, frame 340 is comprised of 2×4 framing members. In another embodiment, frame 340 is comprised of 2×6 framing members. In the first embodiment, the space between vertical members 349*b* and 349*c*, 349*c* and 349*d*, and 349*d* and 349*e* is 16" or less. Spacing of 16" or less between adjacent vertical members may meet or exceed the residential building codes for wall structures in one or more jurisdictions.

Figures 3E, 3F, 3G:
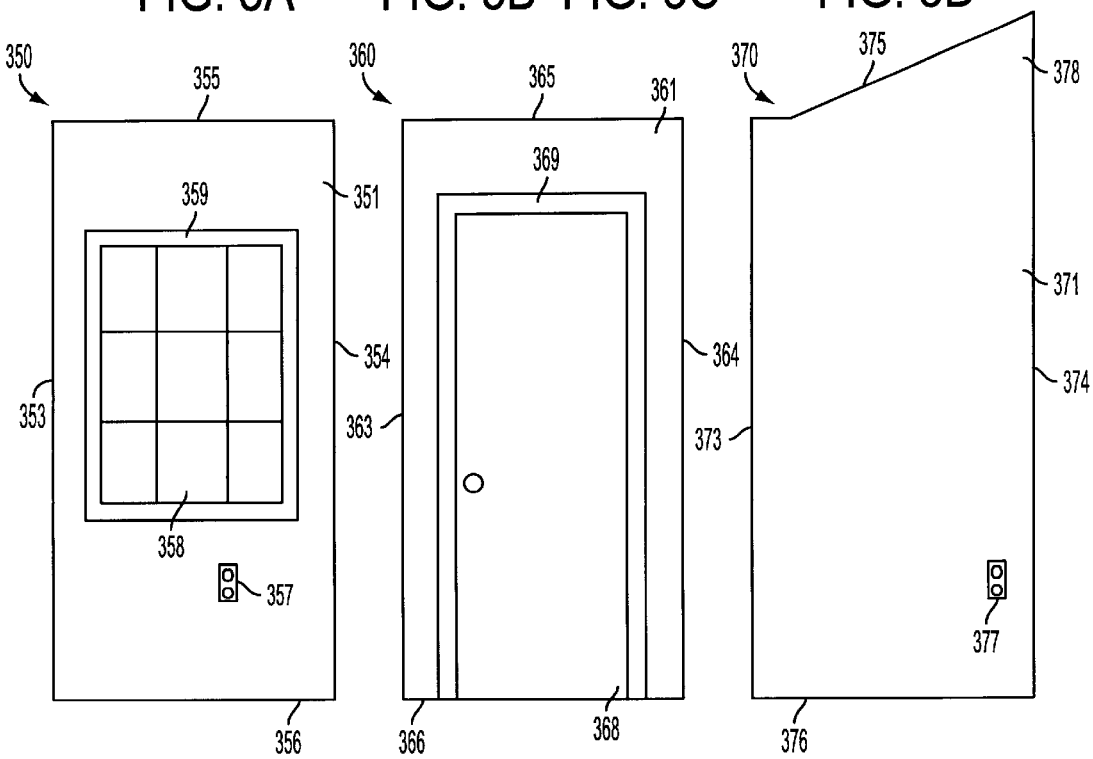
FIG. 3*e* is a front view of a wall panel incorporating a window according to an embodiment of the invention.
FIG. 3*f* is a front view of a wall panel incorporating a door according to an embodiment of the invention.
FIG. 3*g* is a front view of a wall panel incorporating pitched roof support according to an embodiment of the invention.

FIG. 3*e* shows a front view of a wall panel 350. Wall panel 350 has a first side 351, a second side (not shown), a first lateral edge 353, a second lateral edge 354, a top edge 355, and a bottom edge 356. Wall panel 350 may be used in a wall system, such as wall system 101. For example, wall panel 350 may be a portion of an external parallel wall where a window is preferred, like wall panels 120, 121, 122, 123, 124, 125, or 126 in wall system 101. Wall panel 350 has a window 358 disposed therein. An opening in the frame of wall panel 350 may define a space to accommodate window 358. Window 358 may be pre-installed in wall panel 350. In a first embodiment, molding 359 surrounding window 358 may also be pre-installed. Additionally, first side 351 may have a wall covering layer disposed thereon. The second side (not shown) may also have a wall covering layer disposed thereon. In one embodiment, wall panel 310 may have a portion of a house system pre-installed in it. The pre-installed house system may be an electrical system and wall panel 310 may comprise a pre-installed electrical outlet 317.

FIG. 3*f* shows a front view of a wall panel 360. Wall panel 360 has a first side 361, a second side (not shown), a first lateral edge 363, a second lateral edge 364, a top edge 365, and a bottom edge 366. Wall panel 360 may be used in a wall system, such as wall system 101. For example, wall panel 360 may be a portion of an internal parallel wall where a door is preferred, like wall panels 170, 171, and 172 in wall system 101. Wall panel 360 has a door 368 disposed therein. An opening in the frame of wall panel 360 may define a space to accommodate door 368. A door frame (not shown) may be pre-installed in wall panel 360. Door 368 may be pre-installed in wall panel 360. In another embodiment, door 368 may not be pre-installed in wall panel 360, but a spacer member (not shown) may be pre-installed in the door frame to prevent deformation of the wall panel 360 in transit. In one embodiment, molding 369 surrounding door 368 may also be pre-installed in wall panel 360. In one embodiment, first side 361 may have a wall covering layer disposed thereon. The second side (not shown) may also have a wall covering layer disposed thereon. In another embodiment, wall panel 360 may have a portion of a house system pre-installed in it (not shown).

FIG. 3*g* shows a front view of a wall panel 370. Wall panel 370 has a first side 371, a second side (not shown), a first lateral edge 373, a second lateral edge 374, a top edge 375, and a bottom edge 376. Wall panel 370 may be used in a wall system, such as wall system 101. For example, wall panel 370 may be a portion of an internal or external perpendicular wall, like wall panels 131, 132 or 163 in wall system 101. Wall panel 370 comprises a truss portion 378. Truss portion 378 may extend the length of the wall panel to a pitched cathedral ceiling. Truss portion 378 may support one or more roof panels, or truss portion 378 may support a ridge beam for supporting one or more roof panels. First side 371 may have a wall covering layer disposed thereon. The second side (not shown) may also have a wall covering layer disposed thereon. Wall panel 370 may have a portion of a house system pre-installed in it. For example, the pre-installed house system may be an electrical system and wall panel 370 may comprise a pre-installed electrical outlet 377.

Figure 4A:
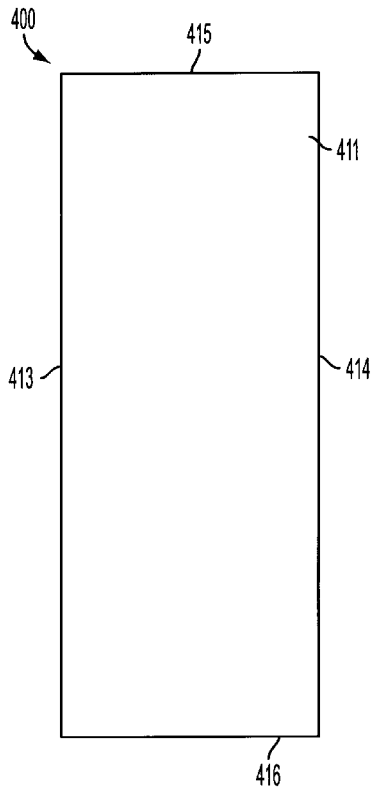
FIG. 4*a* is a top view of a roof panel according to an embodiment of the invention.
Figure 4B:
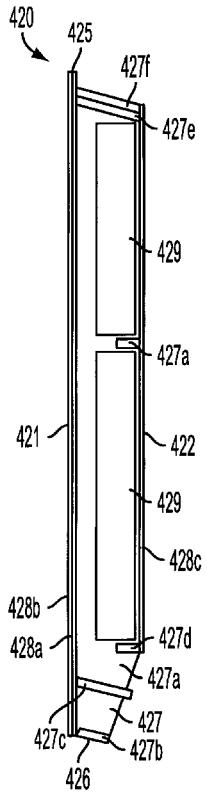
FIG. 4*b* is a cross-sectional view of a roof panel, such as the roof panel of FIG. 4*a*, according to an embodiment of the invention.
Figure 4C:
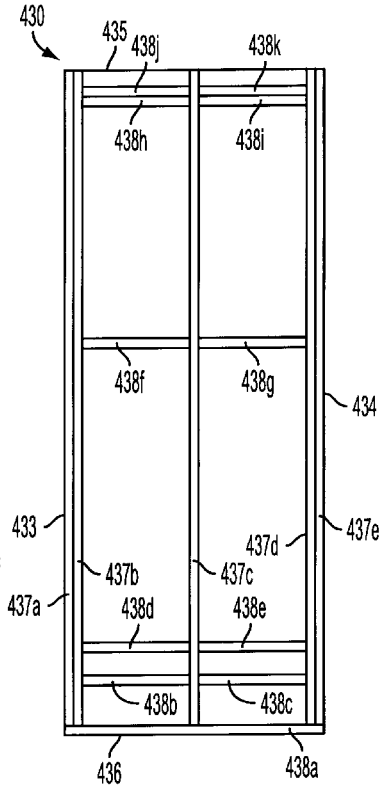
FIG. 4*c* is a top view of the frame of a roof panel, such as the roof panel of FIG. 4*a*, according to an embodiment of the invention.

FIGS. 4*a*–4*c* show a roof panel 400 for use in panelized construction of a building module, such as building module 100. FIG. 4*a* shows a top view of a roof panel 400. Roof panel 400 has an exterior side 411, an interior side (not shown), a first lateral edge 413, a second lateral edge 414, a top edge 415, and a bottom edge 416. Roof panel 400 may be used in a roof system, such as roof system 201. For example, roof panel 400 may be a portion of a pitched roof, like roof panels 211 or 221 in roof system 201. Exterior side 411 may have a roof covering layer disposed thereon. The second side (not shown) may have a ceiling covering layer disposed thereon. The roof covering layer or the ceiling covering layer may not extend to one or more of edges 413, 414, 415, or 416. The gap in the roof covering layer may facilitate attachment of adjacent roof panels by providing access to the frame of roof panel 400. After adjacent roof panels are joined, the gap in the roof covering layer may be sealed using an appropriately sized member of the covering material or another method. Sealing the seams between adjacent roof panels with a member which spans any gap between the adjacent roof panels may prevent weather and other undesired objects from penetrating the roof system. Additionally, the gap spanning member may provide a better base for further finishing of the roof panel surfaces, such as by shingling. In one embodiment, roof panel 400 may have a portion of a house system pre-installed in it (not shown) or roof panel 400 may have a skylight pre-installed in it (shown in roof panel 214 in FIG. 2).

FIG. 4*b* shows a cross-sectional view of a roof panel 420. Roof panel 420 may be an embodiment of roof panel 400 shown in FIG. 4*a*. Roof panel 420 has an exterior side 421, an interior side 422, a first lateral edge (not shown), a second lateral edge (not shown), a top edge 425, a bottom edge 426 and a frame 427. Frame 427 may be comprised of a plurality of longitudinal members, such as member 427*a*, and a plurality of lateral members such as members 427*b*, 427*c*, 427*d*, 427*e*, 427*f*, and 427*f*. Roof panel 420 may further comprise a roof covering layer 428*a*, a roof finishing layer 428*b*, and/or a ceiling covering layer 428*c*. Roof covering layers 428*a*, 428*b* and 428*c* may be comprised of any suitable material, such as gypsum wallboard, plywood sheathing, siding, paneling, shingles or other materials. Pre-installing such roof covering layers 428*a*, 428*b*, and/or 428*c* on said roof panel 420 may save on-site building time. In some cases, the need to access the interior of roof panel 420, such as to reach the inside of frame 427 for attaching adjacent roof panels or to install roof bound portions of house systems, may encourage providing one or more access openings in at least one of the roof covering layers. An appropriate covering for the access opening may also be 110 provided. Panel 420 may further comprise a pre-installed core layer, such as core layer 429. In one embodiment, core layer 429 may be comprised of R32 insulation. Core layer 429 may be suspended within roof panel 420 such that a continuous air space is maintained through at least portions of the roof panel 420. The presence of a continuous air space through roof panel 420 may comply with residential building codes regarding cross-ventilation in at least one jurisdiction. Pre-installation of core layers with roof panels may decrease on-site building time.

FIG. 6*c* shows a cross-sectional view of a roof panel frame 430. Roof panel frame 430 may be an embodiment of frame 427 of roof panel 420. Roof panel frame 430 may comprise a plurality of longitudinal members 437*a*, 437*b*, 437*c*, 437*d*, and 437*e* and a plurality of lateral members 438*a*, 438*b*, 438*c*, 438*d*, 438*e*, 438*f*, 438*g*, 438*h*, 438*i*, 438*j*, and 438*k*. In one embodiment, longitudinal members 437*a*, 437*b*, 437*c*, 437*d*, and 437*e* are comprised of 2×12 framing members. The spacing between adjacent members 437*b* and 437*c* and 437*c* and 437*d* may be no more than 24". This spacing may meet the residential building codes in at least one jurisdiction.

Figure 5:
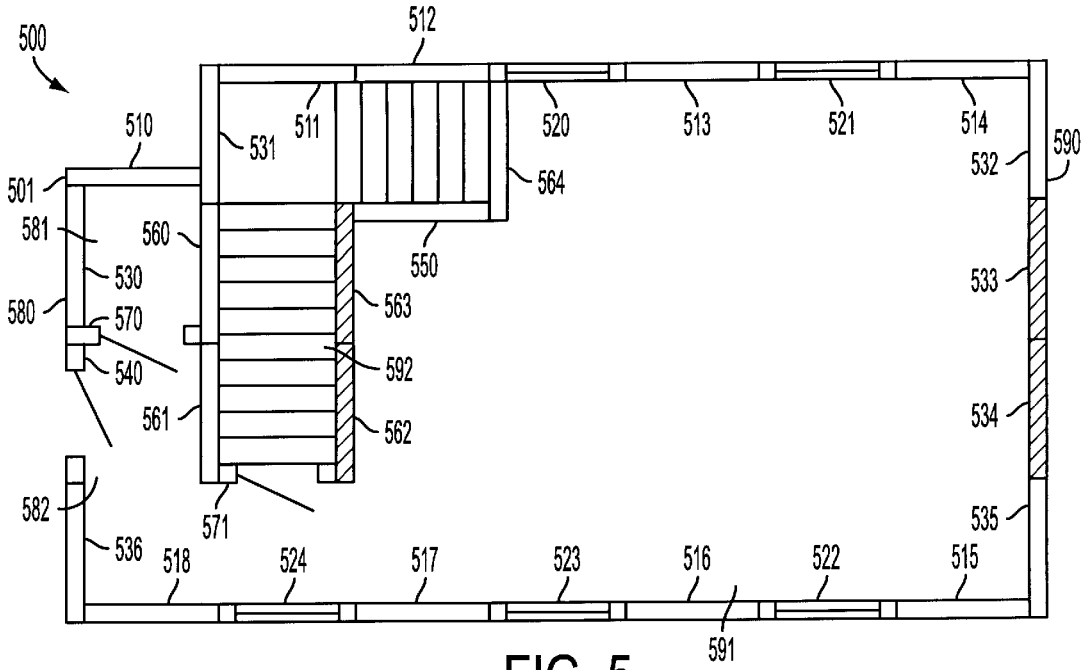
FIG. 5 is a top view of the first floor of a panelized wall system of a two story housing addition according to an embodiment of the invention.

FIG. 5 shows a wall system 501 for the first floor of a two-story building module 500 according to the invention. Wall system 501 comprises a plurality of wall panels, including: a plurality of parallel exterior wall panels 510, 511, 512, 513, 514, 515, 516, 517, and 518; a plurality of parallel exterior wall panels with windows 520, 521, 522, 523, and 524; a plurality of perpendicular exterior wall panels 530, 531, 532, 533, 534, 535, and 536; a perpendicular exterior wall with a door 540; a parallel interior wall 550; a plurality of perpendicular interior walls 560, 561, 562, 563, and 564; and a plurality of interior parallel walls with doors 570 and 571. Wall system 501 defines a transition module 580. The internal space of transition module 580 may define a closet 581 and an entry way 582. Wall system 501 further defines a first floor portion of a main module 590. The internal space of main module 590 may define a family room 591 and a stairwell 592.

Figure 6:
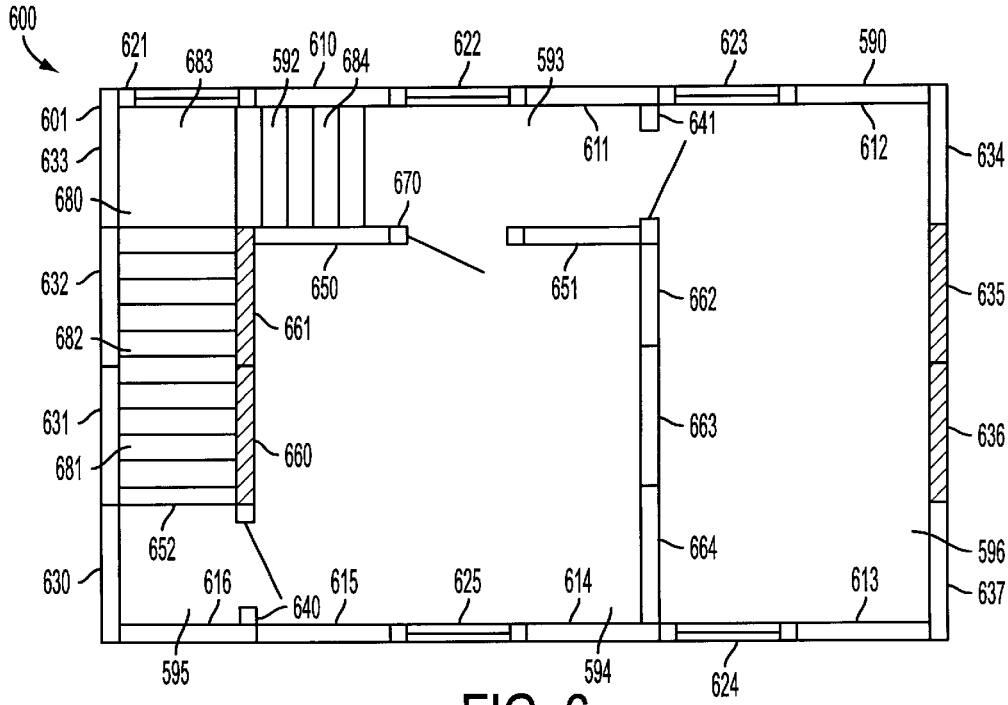
FIG. 6 is a top view of the second floor of a panelized wall system of a two story housing addition according to an embodiment of the invention.

FIG. 6 shows a wall system 601 for the second floor of building module 500. Wall system 601 comprises a plurality of wall panels, including: a plurality of parallel external wall panels 610, 611, 612, 613, 614, and 615; a plurality of parallel external wall panels with windows 620, 621, 622, 623, 624, and 625; a plurality of perpendicular external wall panels 630, 631, 632, 633, 634, 635, 636, and 637; a plurality of interior perpendicular doors 640 and 641; a plurality of interior parallel wall panels 650, 651, and 652; a plurality of interior perpendicular wall panels 660, 661, 662, 663, and 664; and an interior parallel wall panel with a door 670. Wall system 601 defines a defines a second floor portion of main module 590. The internal space of main module 590 may define a hallway 593, a bedroom 594, an closet 595, and a study 596.

In one embodiment, the wall panels of building module 500 and wall systems 501 and 601 may be substantially as shown and described above regarding FIGS. 1 and 3*a*–3*g*.

Building module 500 may comprise a staircase 680. Staircase 680 may include a plurality of stair sections 681, 682, 683, and 684. Stair sections 681, 682, 683, and 684 may be pre-fabricated off-site. Stair section 681 may be attached to the floor of the first story, wall panels 560, 561, 562, and 563, and stair section 682. Stair section 682 may be attached to stair section 681, wall panels 560 and 563, and stair section 683. Stair section 683 may be attached to stair section 682, wall panels 633 and 621, and stair section 684. Stair section 684 may be attached to stair section 683, wall panels 621, 610, 661, and 650, and the floor of the second story. In one embodiment, each of the stair sections is comprised of a support frame (not shown) and attached to the floor of the first story.

Building module 500 may further comprise a roof system substantially as shown and described above regarding FIGS. 2 and 4*a*–4*c*.

Figure 7:
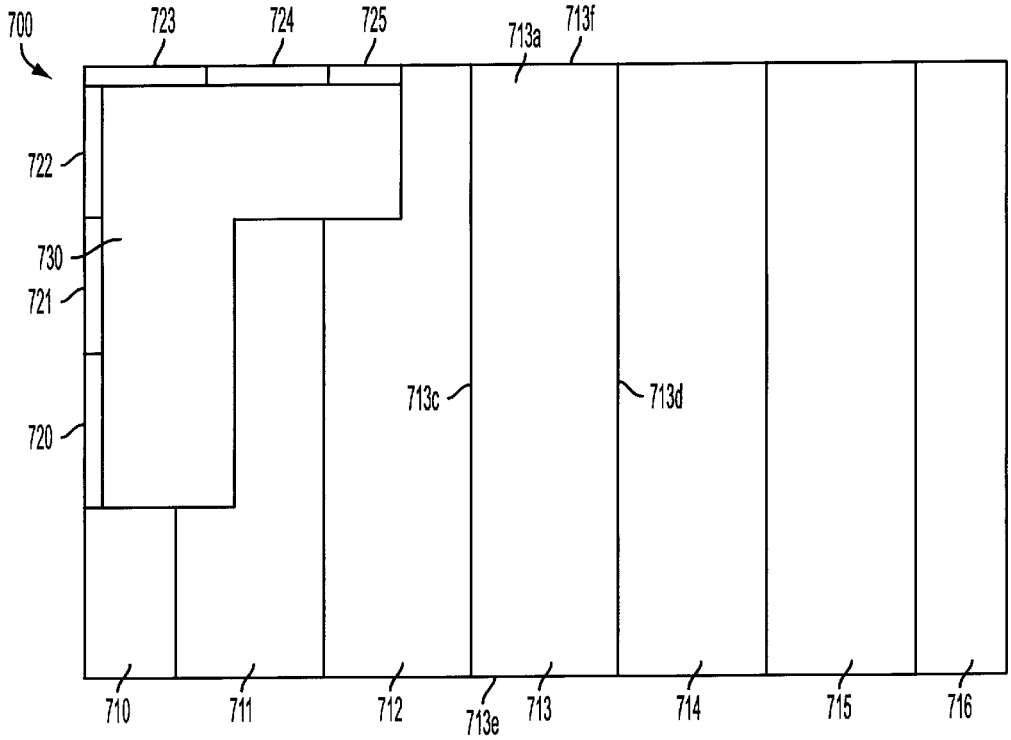
FIG. 7 is a top view of the second floor of a panelized floor system of a two story housing addition according to an embodiment of the invention.

FIG. 7 shows a panelized floor system 700. In one embodiment, floor system 700 may be used as a second story floor system for building module 500.

Floor system 700 may also provide a ceiling system for the first floor of building module 500. Floor system 700 may comprise a plurality of floor panels 710, 711, 712, 713, 714, 715, and 716 and a plurality of spacer members 720, 721, 722, 723, 724, and 725. Floor system 700 may define an opening 730 for accommodating a staircase.

Each of the floor panels may comprise a frame. Each of the floor panels may also have a first side and a second side and a plurality of edges. For example, panel 713 may have a top side 713*a*, an bottom side (not shown), a first lateral edge 713*c*, a second lateral edge 713*d*, a first end 713*e*, and a second end 713*f*. Each of the floor panels is connected to an adjacent floor panel, possibly along one or both lateral edges. Each floor panel is also anchored to a first wall system, such as wall system 501, or to an appropriate base structure, such as basement foundation walls.

Each floor panel may also support a wall system, such as wall system 601. Each floor panel may have one or more covering layers disposed on and substantially covering one or both sides. For example, panel 713 may have gypsum wall board on its bottom side and plywood flooring on its top side. Each floor panel may also comprise core material, such as insulation, or a portion of a house system, such as wiring for an electrical system. In one embodiment, at least a portion of the floor panels may be a standardized width, such as 4'. The floor system may further comprise narrower or wider sections. Narrower or wider sections may allow the floor system to completely span the width of the building module. Narrower or wider sections may also allow the seams between floor panels to be offset from the seams between wall panels of the associated wall systems.

In one embodiment, each floor panel may also have a portion of an attachment assembly for attaching the panel to neighboring floor panels, first story wall panels, and second story wall panels. Attachment of a floor panel to neighboring floor panels and first story wall panels may be accomplished by nails driven at angles through the frames of the neighboring floor panels. Alternatively, attachment of a floor panel to neighboring floor panels and first story wall panels may be accomplished by nut and bolt assemblies inserted through holes in adjacent floor panel frames. Where the floor panels have pre-installed coverings on both sides, access openings may be left in the floor panels to permit access to the frame for use of nut and bolt assemblies or similar assemblies. Other attachment assemblies might include: hinges, fastening plates, screws, adhesives, rods, rivets, welds, wires, cables, toggle bolts, dowels, snap-in-place assemblies, ratchet bolts, keys, tongue and groove assemblies, and combinations of one or more thereof. Second story wall panels may be attached to the floor system of the building module using a sill which is attached to the floor panel system. In one embodiment, the sill may be attached to the floor system by nails or nut and bolt assemblies through the sill and the floor system.

In one embodiment, each spacer member comprises a frame. Spacer members separate a portion of a wall system of a first story, such as wall system 501, from a portion of a wall system of a second story, such as wall system 601. A spacer member may be used in external or internal walls adjacent an opening in the floor system. Spacer members may be positioned between first story and second story wall panels proximate a stairwell. Alternatively, spacer members may be positioned between first story and second story wall panels proximate a room with a cathedral ceiling. The spacer members may further comprise one or more covering layers. The covering layers of spacer members may match the covering layers of the wall panels being joined and/or the floor panels of the floor system of which they are a part.

In one embodiment, floor system 700 may be supported by and attached to a first story wall system, such as wall system 501. Floor system 700 may provide the support structure for a second story wall system, such as wall system 601. For example, floor panel 710 may be supported by and attached to wall panels 518, 524, 561 and 571, attached to floor panel 711, and support wall panels 616, 630, 631, and 652. Floor panel 711 may be supported by and attached to wall panels 524, 517, 571, 562, 563, and 550, attached to floor panels 710 and 712, and support wall panels 616, 615, 640, 660, 661, and 650. Floor panel 712 may be supported by and attached to wall panels 517, 523, 550, 564, and 520, attached to floor panels 711 and 713, and support wall panels 615, 625, 650, 670, and 622. Floor panel 713 may be supported by and attached to wall panels 523, 516, 520, and 513, attached to floor panels 712 and 714, and support wall panels 625, 614, 670, 651, 622, and 611. Floor panel 714 may be supported by and attached to wall panels 516, 522, 513, and 521, attached to floor panels 713 and 715, and support wall panels 614, 624, 664, 663, 662, 651, 641, 611, and 623. Floor panel 715 may be supported by and attached to wall panels 522, 515, 521, and 514, attached to floor panels 714 and 716, and support wall panels 624, 613, 623, and 612. Floor panel 716 may be supported by and attached to wall panels 515, 535, 534, 533, 532, and 514, attached to floor panels 715, and support wall panels 613, 637, 636, 635, 634, and 612.

In another embodiment, floor system 700 may be used as a ceiling system in a building module with an unfinished portion above the ceiling system. A covering layer may be disposed on the bottom side of the ceiling panels. A covering layer may or may not be disposed on the top side of the ceiling panels. Similar panels may also be used to provide ceilings for closets or individual rooms in the building module by spanning only a portion of the area above the wall system.

FIGS. 8*a*–8*d* show a variety of floor or ceiling panels for use in a building module in accordance with the invention. These floor or ceiling panels may be an embodiment of the floor panels of floor system 700, depicted in FIG. 7.

Figures 8A, 8B, 8C, 8D:
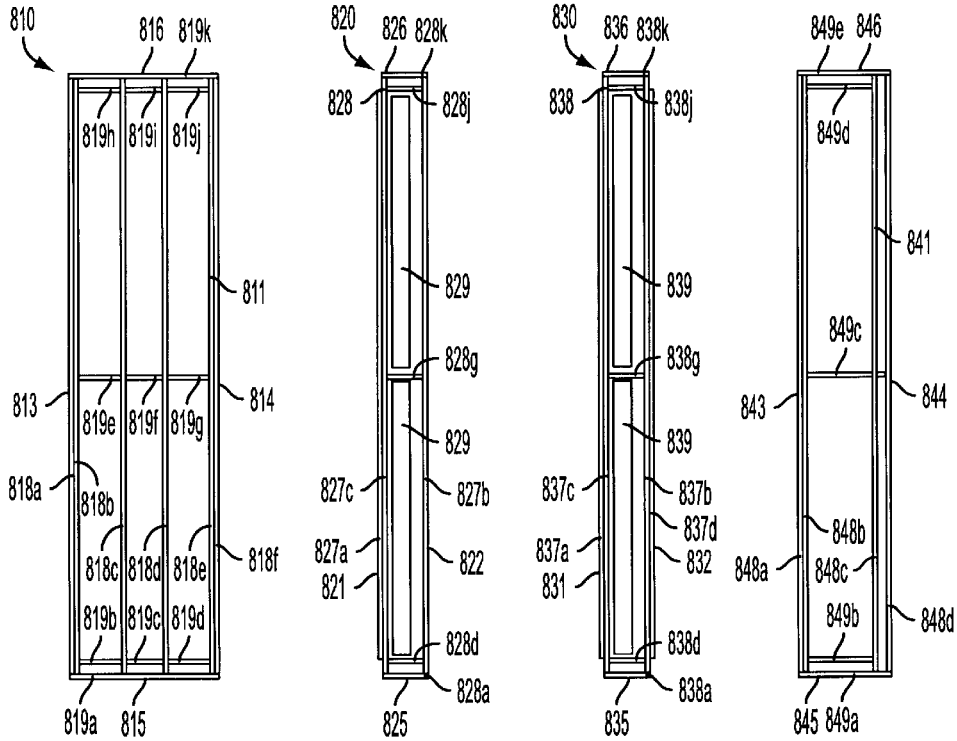
FIG. 8*a* is a top view of the frame of a floor panel according to an embodiment of the invention.
FIG. 8*b* is a cross-sectional view of a floor panel according to an embodiment of the invention.
FIG. 8*c* is a cross-sectional view of a floor panel according to an embodiment of the invention.
FIG. 8*d* is a top view of the frame of a floor panel according to an embodiment of the invention.

FIG. 8*a* shows a top view of a frame 810 of a floor or ceiling panel, such as floor panel 713. Frame 810 has a first side 811, a second side (not shown), a first lateral edge 813, a second lateral edge 814, a first end 815, and a second end 816. Frame 810 maybe comprised of a plurality of longitudinal members 818*a*, 818*b*, 818*c*, 818*d*, 818*e*, and 818*f*, and a plurality of lateral members 819*a*, 819*b*, 819*c*, 819*d*, 819*e*, 819*f*, 819*g*, 819*h*, 819*i*, 819*j*, and 819*k*. Frame 810 may be used as part of a floor system and longitudinal members 818*a*, 818*b*, 818*c*, 818*d*, 818*e*, and 818*f*and lateral members 819*a*, 819*b*, 819*c*, 819*d*, 819*e*, 819*f*, 819*g*, 819*h*, 819*i*, 819*j*, and 819*k* may comprise 2×12 framing members. The spacing between adjacent longitudinal members 818*b* and 818*c*, 818*c* and 818*d*, and 818*d* and 818*e* is no more than 16". Spacing of 16" or less between adjacent longitudinal members may meet or exceed the residential building codes for floor structures in one or more jurisdictions. Alternatively, frame 810 may be used for a non-load bearing ceiling panel and longitudinal members 818*a*, 818*b*, 818*c*, 818*d*, 818*e*, and 818*f* and lateral members 819*a*, 819*b*, 819*c*, 819*d*, 819*e*, 819*f*, 819*g*, 819*h*, 819*i*, 819*j*, and 819*k* may comprise 2×6 and/or 2×4 framing members. In this embodiment, frame 810 may be a standardized width, such as 4'.

FIG. 8*b* shows a cross-sectional edge view of a floor or ceiling panel 820. Panel 820 may be an embodiment of wall panel 713, as shown in FIG. 7. Panel 820 has a top side 821, a bottom side 822, a first lateral edge (not shown), a second lateral edge (not shown), a first end 825, and a second end 826. Panel 820 may have a first floor covering layer 827*a* disposed on top side 821 of frame 828. Panel 820 may have a ceiling covering layer 827*b* disposed on bottom side 822 of a frame 828. Panel 820 may also have a further covering layer 827*c* disposed on either floor covering layer 827*a* or ceiling covering layer 827*b*. Covering layers 827*a*, 827*b*, and 827*c* may comprise any suitable material, such as gypsum wallboard, plywood sheathing, paneling, flooring, or other materials. Covering layer 827*c* may be comprised of a finishing layer of flooring, such as hardwood, tile, carpet, resilient flooring, or other flooring. Alternatively, covering layer 827*c* may be comprised of a material suitable to make panel 820 a 1 hour fire rated assembly. Pre-installing covering layers 827*a*, 827*b*, and 827*c* on panel 820 may save on-site building time. In some cases, the need to access the interior of the panel 820, such as to reach the inside of the frame for attaching panels or to install floor or ceiling bound portions of house systems, may encourage providing one or more access openings in at least one of the covering layers. An appropriate covering for the access opening may also be provided. In this embodiment, the covering layers may not extend to one or more of the lateral edges creating a gap in wall covering layers proximate to the seam between panels. The gap in wall covering may facilitate attachment of adjacent panels by providing access to the frame of wall panel 820. After adjacent panels are joined, the gap in the covering layer may be sealed using an appropriately sized member of the covering material or another method. Sealing the seams between adjacent panels with a member which spans any gap between the panels may prevent undesired spaces in the floor or ceiling system. Additionally, the gap spanning member may provide a better base for further finishing of the panel surfaces. Frame 828 may be comprised of a first end member 828*a*, a second end member 828*k*, a plurality of longitudinal members (not shown), and a plurality of lateral members, such as 828*d*, 828*g*, and 828*j*. Panel 820 may comprise a pre-installed portion of a house system (not shown). For example, the house system may be an electrical system and wiring and fixture housings may be pre-installed in panel 820. The house systems portions pre-installed may also include, other wire systems, such as cable, telephone, speaker systems, security systems, etc., heating, cooling, and ventilation systems, plumbing systems, and other systems. In one embodiment, panel 820 further comprises a core material 829 disposed within the spaces between members in frame 828. For example, core material 829 may be R19 rated insulation. Core material 829 may be positioned to leave a gap between a ceiling covering layer, such as covering layer 827*b*, and the core material. Preferably, the gap may be at least 3".

FIG. 8*c* shows a cross-sectional edge view of a ceiling or floor panel 830. Panel 830 may be an embodiment of floor panel 713, shown in FIG. 7. Panel 830 may be substantially as described above for panel 820, shown in FIG. 8*b*. Panel 830 has a top side 831, a bottom side 832, a first lateral edge (not shown), a second lateral edge (not shown), a first end 835, and a second end 836. Panel 830 may also have a first floor covering layer 837*a* disposed on top side 831 of frame 838, a ceiling covering layer 837*b* disposed on bottom side 832 of a frame 838, and may have a further covering layer 837*c* disposed on either floor covering layer 837*a* or ceiling covering layer 837*b*. Panel 830 may further comprise an additional covering layer 837*d*. Covering layer 837*d* may be disposed on covering layer 837*b* and provide two covering layers on each side of panel 830. Frame 838 may comprise a first end member 838*a*, a second end member 838*k*, a plurality of longitudinal members (not shown), and a plurality of lateral members, such as 838*d*, 838*g*, and 838*j*. In one embodiment, panel 830 further comprises a core material 839 disposed within the spaces between members in frame 838.

FIG. 8*d* shows a top view of frame 840 of a floor or ceiling panel, such as floor panel 716, shown in FIG. 7. Frame 840 has a first side 841, a second side (not shown), a first lateral edge 843, a second lateral edge 844, a first end 845, and a second end 846. Frame 840 further comprises a plurality of longitudinal members 848*a*, 848*b*, 848*c*, and 848*d*, and a plurality of lateral members 849*a*, 849*b*, 849*c*, 849*d*, and 849*e*. In one embodiment, frame 840 may be used as part of a floor system and longitudinal members 848*a*, 848*b*, 848*c*, and 848*d* and lateral members 849*a*, 849*b*, 849*c*, 849*d*, and 849*e* may comprise 2×12 framing members. Alternatively, frame 840 may be used for a non-load bearing ceiling panel and longitudinal members 848*a*, 848*b*, 848*c*, and 848*d* and lateral members 849*a*, 849*b*, 849*c*, 849*d*, and 849*e* may comprise 2×6 and/or 2×4 framing members. In one embodiment, frame 840 may be a non-standardized width less than the width of standardized panels.

Figure 9A:
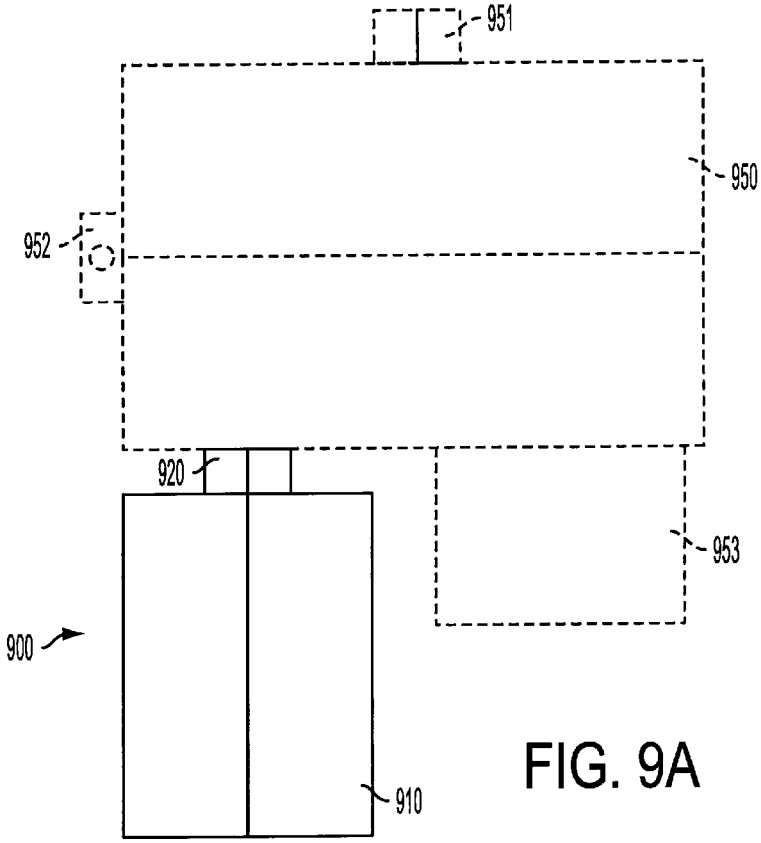
FIG. 9*a* is an overhead view of a housing addition according to an embodiment of the invention.

In FIG. 9*a*, a building module 900 for addition to a residential building according to an embodiment of the invention is shown. Building module 900 is shown positioned behind house 950. House 950 is shown in dotted lines. Building module 900 may have a main module 910 and a transition module 920. A typical house 950 may have a front entrance 951, a chimney 952, a deck 953, or other external or internal features which impact the placement of building module 900. Further, the size, shape, and grade of the lot, the placement of outbuildings or other structures on the lot, the presence of trees, gardens, or other landscaping features, and other considerations may also impact the placement of building module 900.

Figure 9B:
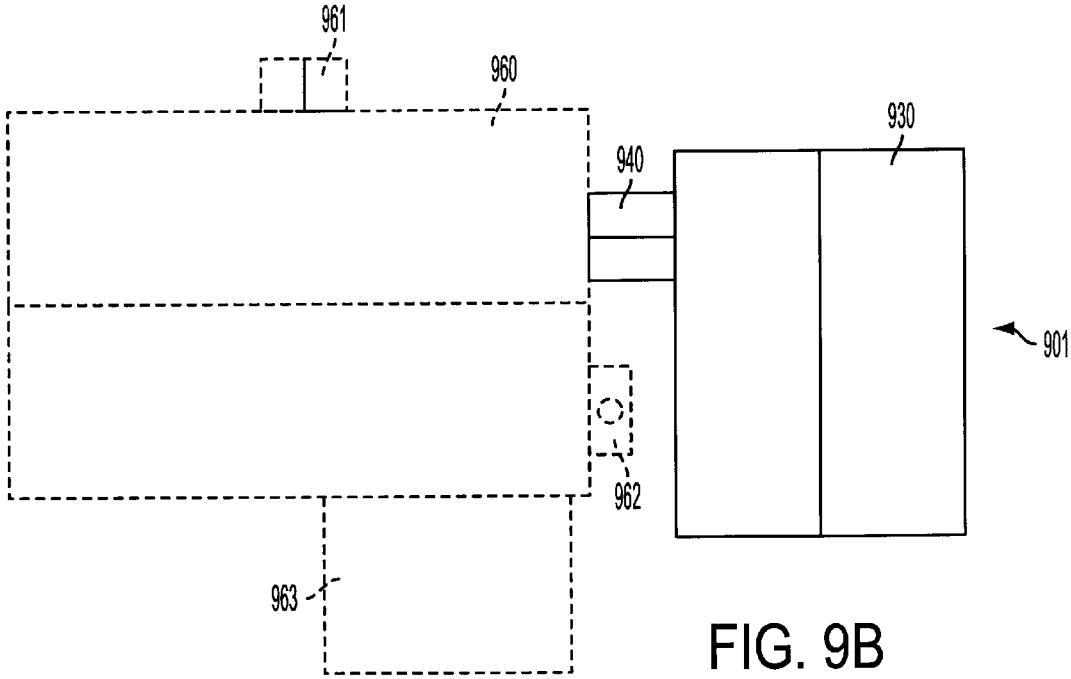
FIG. 9*b* is an overhead view of another housing addition according to an embodiment of the invention.

FIG. 9*b* shows a building module 901 attached to a similar typical house 960. Building module 901 also has a main module 930 and a transition module 940, but in an alternate arrangement than that shown in FIG. 9*a*. House 960 may also have a front entrance 961, a chimney 962, a deck 963 and other house and lot features which impact the placement of building module 901.

The use of a transition module, such as transition modules 920 and 940 shown in FIGS. 9*a* and 9*b*, allows greater flexibility in the placement of a housing addition. While other housing additions may mate to a substantial portion of an existing house, such as an entire wall, building modules 900 and 901 mate with only with a small portion the house. The use of a small transition module may prevent existing external house structures from needing to be moved. This can be particularly important with regard to electrical and other utility hookups, outdoor cooling units, chimneys, and other structures which are costly or impossible to move. Many of these types of external features can be easily accommodated in the space left between the house and the main module of the addition. Use of a transition module may also provide greater flexibility for fitting a particular building module on a particular lot. The transition module may be shortened or extended as needed to space the housing addition nearer to or farther from the existing house. Because the transition area only requires space enough to accommodate a doorway to the house, it may be placed on any wall of the house providing such an area, without regard to external structures, as explained above. The transition module may access the house through an existing external door to prevent any need for large scale modification or remodeling of the existing house. Similarly, it may not interfere with existing windows in the house, as additions which mate with an entire wall of the house might.

According to one embodiment of the invention, a building kit may include the components to substantially complete a building module, such as building modules 100, 500, 900, or 901. The building kit may be purchased by a contractor, do-it-yourselfer, or other builder for the purpose of constructing the building module. The building kit may comprise a plurality of pre-fabricated wall panels, a plurality of pre-fabricated roof panels, and a plurality of fasteners for constructing the building module. The building kit may be pre-fabricated at one or more factory locations and shipped to the building site.

In one embodiment, each of the pre-fabricated wall panels included in the building kit may comprise a frame having a first side, a second side, and a plurality of edges, a first wall covering disposed on the first side, and a second wall covering layer disposed on the second side. Each wall panel may be substantially as described above for the wall panels of FIGS. 1, 3*a*–3*g*, 5, and 6. The wall panels may define a transition module and a main module, as shown in FIGS. 9*a*–9*b*. The building kit may also have at least one door pre-installed in a wall panel, at least one window pre-installed in a wall panel, and/or a portion of at least one house system pre-installed in at least one wall panel. At least one wall panel may include a pre-installed core layer, such as insulation.

Each of the pre-fabricated roof panels included in the building kit may 110 comprise a frame having an exterior side, and interior side, and a plurality of edges and a first roof covering layer disposed on the exterior side. Each roof panel may be substantially as described above for the roof panels of FIGS. 2 and 4*a*–4*c*. The roof panels may define a transition module and a main module, as shown in FIGS. 9*a*–9*b*. The building kit may also have at least one skylight pre-installed in at least one roof panel and/or a portion of at least one house system pre-installed in at least one roof panel. An interior ceiling covering layer may also be pre-installed on the at least one roof panel. At least one exterior finishing layer may also be pre-installed on the at least one roof panel. The at least one roof panel may further comprise a pre-installed core layer, such as insulation.

The building kit may further comprise at least one floor panel. Each floor panel may be comprised of a frame having a top side, a bottom side, and a plurality of edges and a floor covering layer disposed on the top side. Each floor panel may be substantially as described above for the floor panels of FIGS. 7 and 8*a*–8*d*. The building kit may also have a portion of at least one house system pre-installed in at least one floor panel. Additionally, an interior ceiling covering layer may be pre-installed on the bottom side of the at least one floor panel. The at least one floor panel may also comprise a pre-installed core layer, such as insulation.

The building kit may further comprise at least one ceiling panel. Each ceiling panel may be comprised of a frame having a top side, a bottom side, and a plurality of edges and a ceiling covering layer disposed on the bottom side. Each ceiling panel may be substantially as described above for the floor or ceiling panels of FIGS. 7 and 8*a*–8*d*. The building kit may also have a portion of the at least one house system pre-installed in at least one ceiling panel. A covering layer may also be pre-installed on the top side of the at least one ceiling panel. The at least one ceiling panel may be a non-load bearing assembly. The at least one roof panel may also comprise a pre-installed core layer, such as insulation.

The building kit may further comprise additional materials to complete the construction and/or finishing of the building module. For example, the building kit may include fasteners and structural materials for connecting and supporting the panels of the building module. These fasteners may include nails, screws, nut and bolt assemblies, gap spanning members, fastener plates, and/or other fastener assemblies or portions thereof. The structural materials may also include one or more ridge beams, one or more pipe columns, sills for attachment to a base structure, support and attachment members for attachment to an existing building module, and other structural materials.

The building kit may further comprise materials to complete one or more house systems. For example, if the house system is an electrical system, the materials included in the building kit may include: wiring, electrical boxes, outlets and covers, switches and covers, fixture housings, fixtures, and/or other materials. If the house system is a heating, cooling, or ventilation system, the materials included in the building kit may include: duct work, vents, registers, heating units, air conditioning units, fan units, filter units, combination units, thermostats, wiring, and/or other materials. Where the house system is a plumbing system, the materials included in the building kit may include: pipes, pumps, water heaters, fixtures, cabinetry, vanities, showers, bathtubs, and/or other materials. The house system may comprise other wire systems such as cable, telephone, computer network, security system, speaker system, and the materials included in the building kit may be wiring, jacks, other hardware, and/or other materials.

The kit may further comprise finishing materials for finishing the exterior of the building module. The finishing materials may include: siding, roofing, bricks and mortar, flashing, gutters, exterior paint, shutters, exterior trim, porch materials, deck materials, and other materials.

The building kit may also comprise finishing materials for finishing the interior of the building module. The finishing materials may include, for example: dry wall tape, dry wall compound, molding, interior paint, paneling, wall paper, ceiling texturing, cabinetry, countertops, shelving, closet organizers, carpet, tile, resilient flooring, hardwood flooring, fixtures, window treatments, and other finishing materials.

The building kit may also contain instructions for constructing the building module. The instructions may include detailed drawings, written step-by-step instructions, instructional video recordings, audio recordings, software, multimedia presentations, and/or other media, or other instructions. The instructions may also include information for accessing technical support, such as local or on-site consultants, telephone support, on-line support, or other support.

A method of constructing a building module is a further embodiment of the present invention. The method may comprise the step of providing a base structure for the building module. The base structure may be a foundation, such as a concrete pad, basement walls, or other foundations, an existing building structure, a chassis for a mobile building module, such as a mobile home, a panelized floor system, or other base structures.

The method further comprises the step of positioning a plurality of pre-fabricated wall panels on the base structure. Each of the pre-fabricated wall panels may be comprised of a frame having a first side, a second side, and a plurality of edges, a first wall covering disposed on the first side, and a second wall covering layer disposed on the second side. Each wall panel may be substantially as described above for the wall panels of FIGS. 1, 3*a*–3*g*, 5, and 6.

The method further comprises the step of attaching the plurality of pre-fabricated wall panels to the base structure and to each other to comprise a wall system. The wall system may be substantially as described above for FIGS. 1, 5, and 6. Attachment may comprise the use of additional members and/or fastener assemblies.

The method may further comprise the step of positioning a plurality of pre-fabricated roof panels on the wall system. Each of the pre-fabricated roof panels may include a frame having an exterior side, and interior side, and a plurality of edges and a first roof covering layer disposed on the exterior side. Each roof panel may be substantially as described above for the roof panels of FIGS. 2 and 4*a*–4*c*.

The method further comprises the step of attaching the plurality of pre-fabricated roof panels to the wall system and to each other to comprise a roof system. The roof system may be substantially as described above for FIG. 2. Attachment may comprise the use of additional members, such as one or more ridge beams or transition members between the wall system and the roof system, and fastener assemblies.

Finally, the method includes the step of finishing the building module using various additional materials. Such finishing step may include finishing the exterior of the module, finishing the interior of the module, or finishing or installing various house systems.

This invention has been described in connection with the preferred embodiments. These embodiments are intended to be illustrative only. It will be readily appreciated by those skilled in the art that modifications may be made to these preferred embodiments without departing from the scope of the invention as defined by the appended claims.

What is claimed is:

1. A building module comprising:

a plurality of pre-fabricated floor panels, each of said pre-fabricated floor panels including:

a frame having a top side, a bottom side, and a plurality of edges;

a floor covering layer disposed on said top side; and means for connecting said pre-fabricated floor panels to each other; and a structural design by which said pre-fabricated floor panels are constructed and positioned and attached in relation to one another; and wherein at least one of said floor panels is a load-bearing floor panel.

2. The building module of claim 1, further comprising a transition module for attachment to an existing building.

3. The building module of claim 1, wherein at least one of said floor panels further comprises a ceiling covering layer disposed on said bottom side.

4. The building module of claim 3, wherein said floor panel comprises a one-hour fire-rated assembly.

5. A building kit for constructing a building module comprising:

a plurality of pre-fabricated load-bearing wall panels, each of said wall panels comprising:

a frame having a first side, a second side, and a plurality of edges;

a first wall covering layer disposed on said first side; and a second wall covering layer disposed on said second side;

at least one floor panel, said floor panel including:

a frame having a top side, a bottom side, and a plurality of edges;

a floor covering layer disposed on said top side; and a plurality of fasteners for connecting said floor panel to said load-bearing wall panels.

6. The kit of claim 5, further comprising at least one ceiling panel, said ceiling panel comprising:

a frame having a top side, a bottom side, and a plurality of edges;

a ceiling covering layer disposed on said bottom side; and a plurality of fasteners for connecting said ceiling panel to said load-bearing wall panels.

7. The kit of claim 5, wherein a portion of a house system is pre-installed in at least one wall panel or floor panel.

8. The building kit of claim 7, further comprising materials to complete the house system.

9. The building kit of claim 5, wherein insulation is pre-installed in at least one of said wall panels or said roof panels.

10. The building kit of claim 5, further comprising finishing materials for finishing the interior of the building module.

11. The building kit of claim 5, further comprising finishing materials for finishing the exterior of the building module.

12. The building kit of claim 5, further comprising instructions for constructing the building module.

13. The kit of claim 5, wherein an interior ceiling covering layer is pre-installed on at least one of said ceiling panels.

14. A method of constructing a building module comprising the steps of:

providing a base structure for the building module;

positioning a plurality of pre-fabricated load-bearing wall panels on the base structure, the pre-fabricated load-bearing wall panels comprising:

a frame having a first side, a second side, and a plurality of edges;

a first wall covering layer disposed on said first side; and a second wall covering layer disposed on said second side;

attaching the plurality of pre-fabricated wall panels to the base structure and to each other to comprise a wall system;

positioning a plurality of pre-fabricated floor panels on the wall system, the pre-fabricated floor panels comprising:

a frame having a top side, a bottom side, and a plurality of edges; and a floor covering layer disposed on said top side; and attaching the plurality of pre-fabricated floor panels to the wall system and to each other.

* * * * *